United States Patent [19]

Widdowson

[11] 4,236,875

[45] Dec. 2, 1980

[54] PRESSURE OPERATED HYDRAULIC CONTROL VALVE

[75] Inventor: Richard E. Widdowson, Dayton, Ohio

[73] Assignee: General Motors Corporation, Detroit, Mich.

[21] Appl. No.: 81,867

[22] Filed: Oct. 4, 1979

Related U.S. Application Data

[63] Continuation of Ser. No. 896,741, Apr. 17, 1978, abandoned.

[51] Int. Cl.[3] ..... F04B 1/28; F16K 31/12

[52] U.S. Cl. ..... 417/222; 251/57

[58] Field of Search ..... 417/222, 269, 270; 251/57

[56] References Cited

U.S. PATENT DOCUMENTS

| | | | |
|---|---|---|---|
| 3,062,620 | 11/1962 | Heidorn | 417/269 |
| 3,372,902 | 3/1968 | Gotzenberger | 251/321 |
| 3,525,234 | 8/1970 | Widdowson | 62/217 |
| 3,637,187 | 1/1972 | Burger | 251/57 |
| 4,037,993 | 7/1977 | Roberts | 417/222 |
| 4,052,035 | 10/1977 | Kenny et al. | 251/57 |
| 4,073,603 | 2/1978 | Abendschein | 417/222 |

*Primary Examiner*—William L. Freeh
*Attorney, Agent, or Firm*—Edward P. Barthel

[57] ABSTRACT

A pressure operated control valve operative to regulate the flow of fluid to a hydraulic modulating cylinder having a fixed hydraulic bleed which cylinder operates a mechanism for varying the displacement of a compressor of an automotive air conditioning system to maintain a predetermined control or system pressure. The system pressure continually surrounds a sealed bellows seated in the closed end of a tubular bellows cover. High pressure fluid is continually supplied to the control valve which has a ball and seat to totally restrict fluid flow to the modulating cylinder when the system pressure exceeds the setting pressure of the valve. When the system pressure drops below the setting pressure, the bellows extends against an axial pin which forces the ball from its seat, thus allowing high pressure fluid to flow to the compressor modulating cylinder operating the compressor mechanism and reducing the stroke of the compressor pistons. When the system pressure returns to the setting pressure, the bellows retracts moving the ball toward its seat thereby reducing hydraulic fluid flow to the modulating cylinder.

7 Claims, 3 Drawing Figures

PRESSURE OPERATED HYDRAULIC CONTROL VALVE

This is a continuation, of application Ser. No. 896,741, filed Apr. 17, 1978, now abandoned.

This invention relates to a control valve assembly and more particularly to a pressure operated hydraulic control valve assembly for varying the output of an automotive air conditioning compressor via its hydraulically operated modulating cylinder.

In the U.S. Pat. No. 4,061,443, filed Dec. 2, 1976, and issued to Dennis A. Black and Byron L. Brucken on Dec. 6, 1977, and in U.S. Pat. No. 4,050,852, filed Sept. 13, 1976 and issued to Byron L. Brucken and Roy E. Watt on Sept. 27, 1977, both patents being assigned to the same assignee as the present application, a variable displacement automotive air conditioning compressor is described with one form of my hydraulic control valve. In the present invention another form of my hydraulic control valve is adapted to be used in an automotive air conditioning system employing a refrigerant gas compressor such as disclosed in the mentioned Black et al patent.

It is an object of the present invention to provide an improved pressure operated hydraulic control valve assembly for controlling the compressor of an automotive air conditioning system by regulating the flow of pressurized hydraulic fluid to the compressor's modulating cylinder having a fixed hydraulic bleed. The modulating cylinder operates mechanism for varying the compressor displacement to maintain an air conditioning system pressure at the control valve setting pressure. The system or control pressure continually surrounds a sealed bellows seated in the closed end of a bellows cover portion of the valve assembly. Pump means driven by the compressor continuously supply high pressure fluid to the valve inlet cavity and acts against resiliently biased valve ball means to seat same to restrict the hydraulic fluid flow when the system control pressure reaches the valve setting pressure. When the system control pressure falls below the setting pressure, the bellows extends against valve pin means which forces the ball means from its seat, thus allowing high pressure fluid to flow from the inlet cavity to the compressor hydraulic modulating cylinder causing the cylinder to extend resulting in the compressor mechanism reducing the stroke of the compressor pistons. Upon the system pressure again reaching the valve setting pressure, the bellows will retract allowing resilient means together with high pressure hydraulic fluid acting on the ball means to return the ball means toward its seat to restrict the hydraulic fluid flow of the valve.

It is a further object of the present invention to provide an improved variable output automotive air conditioning compressor having casing means including a front end cover and a rear head enclosing a cylinder block, hydraulically operated modulating means for varying the output of said compressor, and pump means for supplying hydraulic fluid to the modulating means. The compressor rear head inner face is formed with suction and discharge cavities on its inner face together with a closed end housing integrally formed on the rear head such that the housing defines the valve housing of a pressure operated hydraulic control valve assembly including a bellows seated in a sealed pressure control cell defined in part by a bellows cover portion of the valve assembly for controlling the output of the compressor. Pump means of the compressor continuously supplies high pressure fluid to the valve inlet cavity and acts, together with resilient means, to move valve ball means to seat same to restrict the hydraulic fluid flow when the system or control pressure reaches the valve setting pressure. Aperture means are provided in the rear head valve housing in communication with aperture means in the valve bellows cover adapted to communicate suction control pressure from the compressor rear head suction cavity to the bellows control cell whereby the hydraulic control valve acts to extend the compressor modulating means and reduce the compressor capacity when the suction pressure exceeds the valve predetermined control pressure and to increase the compressor capacity when its suction pressure is less than the predetermined system pressure.

It is still another object of the present invention to provide an improved spring loaded ball and seat valve for use in regulating the flow of high pressure hydraulic fluid wherein the valve seat is in the form of an open ended sleeve formed as a valve chamber converging from an inlet end toward an outlet end forming a dome-shaped valve seat portion adjacent the outlet end. Valve and guide means in the form of first and second ball segments and a helical compression spring are positioned for reciprocal movement in the valve chamber with the first ball movable in the dome-shaped portion between open and closed positions to sealingly mate with the valve seat portion to close the valve outlet while the second ball segment, of a predetermined reduced size, is movable in the converging portion adjacent the chamber inlet end. The ball segments are secured together in abutting relation to form a unitary piece having large and small ball portions defined by the first and second ball segments with the large ball portion forming a valve for the valve seat portion and the small ball portion forming with the spring a guide for the unitary piece. The spring is carried in the valve chamber so as to converge therewith while the spring is substantially concentrically aligned on the chamber principal axis with the spring's large diameter end in abutting engagement with the inside of the sleeve inlet end. The spring smaller diameter end is snap-fastened over the small ball portion for capture between the large and small ball portions. The large ball portion is guidingly retained for movement in the valve chamber between valve open and closed positions by the coaction of the small ball portion and the spring while the large ball portion is being biased toward its closed position against the valve seat. A valve pin, having a needle or stem portion engageable with the large ball portion through the sleeve outlet, is operative for moving the valve and guide means toward the valve open position against the bias of the spring, with the outlet end having a configuration sufficiently large simultaneously to receive the needle and supply the fluid in regulating the flow thereof when the valve and guide means is away from the valve seat portion and between the valve open and closed positions.

Further objects and advantages of the present invention will be apparent from the following specification, reference being had to the accompanying drawings of which:

Figure 1:
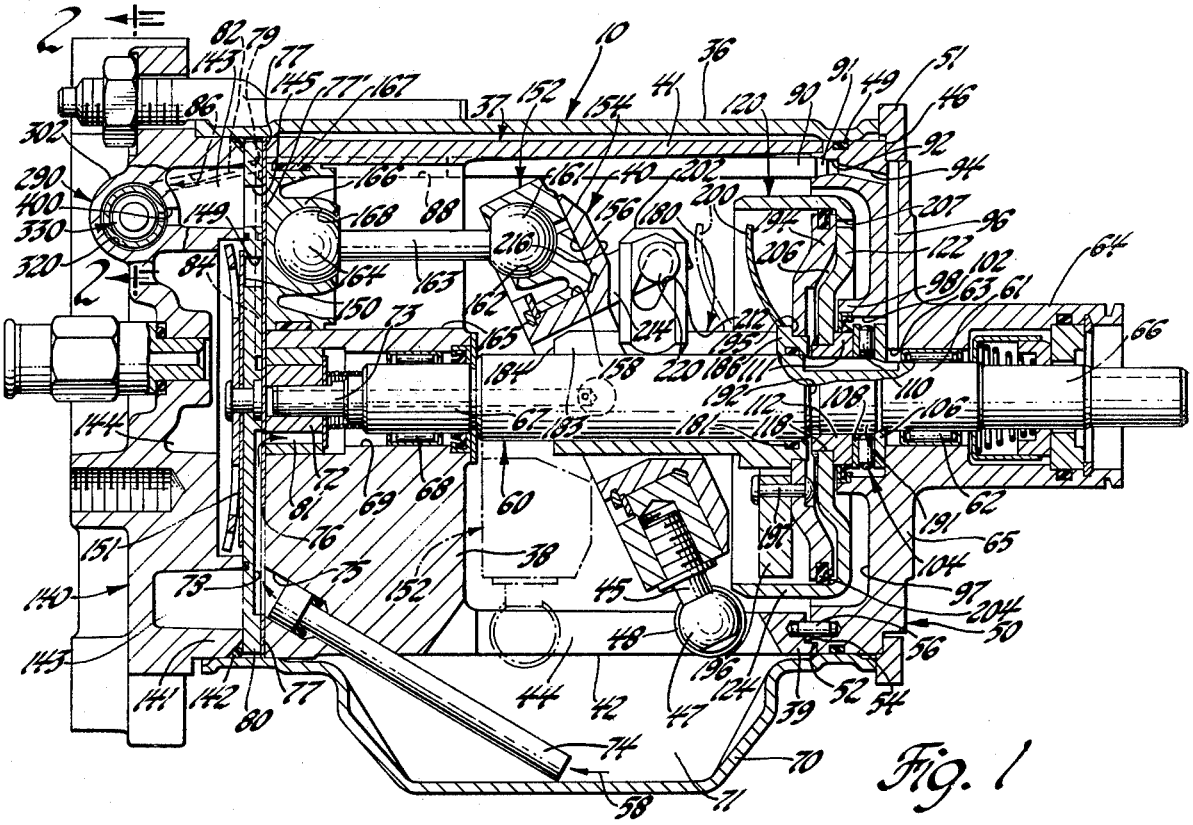
FIG. 1 is a vertical sectional view showing an axial wobble plate compressor for use with the present invention.

Referring now to the drawings, wherein a preferred enbodiment of the present invention is shown, numeral 10 in FIG. 1 designates a variable displacement axial wobble plate compressor which is adapted to be driven by a main car engine through suitable means, one example of which is shown and described in the mentioned Black, et al U.S. Pat. No. 4,061,443. The Black patent shows a compressor driven from a car motor by a belt and pulley arrangement in combination with an electromagnetic clutch shown and described in copending U.S. patent applications Ser. No. 798,583 and Ser. No. 804,932, both assigned to the same assignee as the instant application.

The compressor 10 includes an outer shell 36, which is substantially cylindrical in shape formed from sheet metal or as a casting. The shell 36 encircles an inner cylinder case, generally indicated at 37, preferably cast in one piece from aluminum. The case 37 comprises a rear cylinder block 38 and a front cylinder collar 39 with a wobble plate mechanism generally indicated at 40 positioned therebetween. The cylinder case block 38 and collar 39 are interconnected by a pair of longitudinally extending stringers, one of which is indicated at 41 and a guide stringer 42 for the reception of a guide rod 45 supporting a universal ball 47 between a pair of guide shoe assemblies 48.

A front head 50, preferably formed as a separate member such as, for example, an aluminum casting, is partially telescoped at the right or front end of the shell 36 and is suitably sealed thereto as by O-ring seal 49. An outer peripheral notch 46 is formed on the front head 50 for flush engagement of a ring 51, which ring is suitably secured as by welding to circumscribe the front end of the shell 36. The front head 50 has an inner annular recess 52 which telescopically interfits the complementary recess 54 of the collar 39 in nested fashion which together with connecting pins 56 align compressor bearing bores for reception of the compressor main drive shaft 60.

The compressor main drive shaft 60 has its forward bearing portion 61 rotatably mounted or journaled on front needle bearing 62 in axial bore 63 formed in protruding integral tubular extension 64 located on the outer surface of the front head end cover portion 65. The extension 64 is coaxial with and surrounds the shaft intermediate end 66 is concentric fashion. The shaft has its rearward reduced end 67 journaled on rearward needle bearing 68 in rear axial bore 69 of the cylinder block 38.

The shell 36 completely encloses the compressor wobble plate mechanism 40 and is provided with a distended bulge portion 70 forming an oil sump or crankcase region 71 which collects, by gravity flow, oil and refrigerant mixed therein received from piston blowby for circulation through the compressor by suitable oil flow passages providing a lubricating network for its associated bearings and seals. Lubricating oil gear pump means in the form of an oil pump assembly 72, driven by a D-shaped quill 73 providing a reduced end extension of the shaft rearward end 67, serves to withdraw oil and refrigerant solution from the sump 71 to an oil pickup tube or conduit 74. The tube 74, with its open upper end inserted at an angled counterbore 75 of the cylinder block 38, communicates via aperture 76 in reed valve disc 77 with an aligned vertical slotted passage 78, formed in the inner surface of the valve plate 80. The passage 78 has its upper end positioned in communication with the inlet side 81 of the oil pump 72.

The pump 72 outlet communicates with valve plate 80 upper oil outlet groove, indicated by dashed lines at 84, with the groove 84 extending radially outwardly and terminates adjacent the periphery of the valve plate 80 so as to communicate with a rear head control valve fluid inlet bore 86. The valve plate 80 includes passage means (not shown) connecting valve housing exit passageway 388 with the inlet of axially extending cylinder block longitudinal duct 88, shown by dashed lines in FIG. 1. The forward or outlet end of the duct 88 is connected to the rearward end of an axially aligned crossover tube 90, located outboard of the wobble plate mechanism 40. The crossover tube 90 portion of the crossover passage means has its forward or outlet end reduced at 91, as by swaging, to provide a sealed press fit within the conical aperture 92 in the front head 50.

The front head 50 provides duct means communicating with the crossover tube outlet 91 in the form of an obliquely downwardly sloped duct portion 94 communicating with the outer end of a radial duct portion 96, the inner end of which is open to the front head axial bore 63. The front head inner face 97 includes a sleeve-like concentric extension 98 which, with tubular extension 64, is formed integral with the front head. The rearwardly directed extension 98 encloses a counterbored shoulder portion 102 defining a thrust bearing surface on which is seated front thrust needle bearing assembly 104, including outer and inner thrust rings 106 and 108, respectively, having needle bearings 110 therebetween. The outer ring 108 is in flush engagement with flange 111 of cylinder bushing 112 fixedly centered as by welding in axial bore 118 of a cup-shaped modulation cylinder, generally designated 120. The cup-shaped cylinder 120 is oriented with its base 122 in opposed relation to the inner face 97 of the front head cover end wall portion 65. The cylinder 120 has cylindrical wall portion 124 extending rearwardly from its base 122 such that the open end of cup-shaped cylinder faces the wobble plate mechanism 40.

The valve plate 80 is held against the end of the cylinder block 38 by means of a cylinder rear head assembly 140 having a cylindrical portion 141 which telescopes within the aft end of the shell 36 and is sealed thereto by compressible sealing means shown in the present form as O-ring 142 sealed to the shell. The rear cylinder head assembly includes an outer section or inlet chamber 143 and a center discharge chamber 144. As shown in FIG. 1, each compression chamber or bore 165 communicates with the suction chamber 143 through an inlet port such as port 145. The inlet reed valve disc 77 having inlet reeds 77', controls the flow of refrigerant through the suction inlet ports 145 as shown in detail in the Black, et al patent 4,061,443. The compressed refrigerant leaves each compression bore 165 through valve plate discharge port 149 while reed valves 150, formed in discharge reed valve disc 151, are located in each discharge port 149.

For purposes of illustration, the variable displacement five cylinder axial compressor 10 will be described. However, it will be understood that the number of cylinders may be varied without departing from the scope of the invention.

With reference to FIG. 1, the wobble plate drive mechanism 40 includes a socket plate or collar 152 and a journal or wobble plate 154. The wobble plate 154 and socket plate 152 define a plane bearing surface 156 and an outer cylindrical journal surface 158. The wobble plate 154 rotates in unison with the shaft 60 by virtue of being pivotally connected thereto in a manner to be described. The socket plate 152 has five sockets formed therein, one of the sockets being shown at 162, for receiving the spherical ends 161 of each of five connecting rods, one rod being shown at 163. The free end of each of the connecting rods are provided with spherical portions 164 as shown by rod 163. Cylinder block 38 has a plurality of axial cylinder bores 165, there being five in the disclosed form, in which pistons 166 are sealed by rings 167. The pistons 166, having socket-like formations 168 engage the end 164 of an associated connecting rod 163. Thus, the pistons 166 operate within their associated compression chambers or bores 165, whereby upon rotation of the drive shaft 60 and the journal plate 154 will result in reciprocation of the pistons 166 within their bores. The wobble plate 152 is prevented from rotating by means of the guide shoes 48 which slide within the longitudinal slot 44 provided in the stringer 42.

A generally cylindrical sleeve 180 surrounds or circumscribes the shaft 60 in hydraulic sealing rotation therewith by means of a compressible sealing means such as O-ring seal 181. The sleeve member 180 has formed therein a longitudinal slot 183 extending from the sleeve inner or rearward face 184 substantially the full length of the sleeve and terminates in a radiused portion 186 within the confines of the cup-shaped modulation cylinder 120.

As seen in FIG. 1, sleeve reciprocating actuator or modulating means are provided by hydraulic expansible chamber 205 which includes the modulating cylinder 120 shown suitably affixed by means of its bushing 112 on the shaft portion 191 and abutting against shaft shoulder 192 so as to rotate with shaft 60. The actuator means further includes an axially movable internal disc-shaped modulating piston member 194 having a counterbalance 196 suitably joined thereto as by a rivet 197. In the disclosed form the modulating piston 194 abuts sleeve shoulder 195 and is fixed on the sleeve 180 for rotation therewith. A spring member 200 is suitably retained on the sleeve. Upon the modulating piston 194 and sleeve 180 being moved axially to the left, from their full line to their dashed line positions as viewed in FIG. 1, the spring 200 is compressed by virtue of contacting drive lug 202. This results in the wobble plate mechanism 40 being pivoted to its vertical or zero stroke dashed line position normal to the shaft 60. The spring member 200 operates to bias the wobble plate mechanism 40 from its zero stroke position, normal to the shaft 60, allowing the pistons 166 to commence pumping or compressing refrigerant gas for the system. It will be noted that suitable hydraulic fluid seal means are provided between the disc-shaped piston 194 and the inner annular surface of the cylinder 120 which seal means in the disclosed form is a resilient seal ring 204 located in a peripheral groove formed in the edge of the piston 194.

The size of the expansible chamber 206 is varied by an hydraulic control system regulating the flow of hydraulic control fluid such as oil under pressure into the chamber 206. Upon the system directing high pressure oil into chamber 206, the disc-shaped piston 194 on sleeve 180 will be shifted axially rearwardly or to the left pivoting wobble plate 152 to its dashed line zero stroke position in FIG. 1. Upon the system reducing or blocking the flow of pressurized oil into the wobble plate mechanism 40 tending to return to full stroke causes the piston 194 to be moved forwardly or to the right resulting in the oil in the chamber 206 exiting therefrom through a bleed hole, shown at 207 in the modulating cylinder base wall 122. The drive lug portion 202, which is secured in a transverse bore in the drive shaft 60 and extends in a direction normal to the principal axis of the shaft, has formed therein a guide slot or cam track 212 extending radially along the axis of the drive shaft 60. The wobble plate 154 carries an ear-like member 214 projecting normal to the plate face 216 and has a through bore for receiving cam follower means in the form of a cross pin driving member 220.

As shown in the above-mentioned U.S. Pat. No. 4,061,443 to Black, et al, the ear 214 is offset from but parallel to a plane common to the drive shaft principal axis and the sleeve slot 183. Upon the cross pin 220 contacting bottom radius 211 of the cam track 212 the plate 154 is disposed in a plane perpendicular to the axis of rotation of the shaft 60 rendering the compressor ineffective to compress refrigerant gas. At its zero stroke mode the pin 220 is located at the radially inward limit of cam track 212 so as to define a minimum or zero stroke length for each of the pistons 166. FIG. 1 shows the arrangement of the wobble plate mechanism 40 for maximum compressor capacity wherein the pin 220 is positioned at the radially outer end of the cam track 212. In this manner the radiused ends of the cam track 212 provide limits to define respectively, the maximum and minimum stroke lengths for each of the pistons 166. By virtue of this arrangement the wobble plate mechanism 40 provides essentially constant top-dead-center positions for each of this pistons. The cam follower pin 220 interconnects the wobble plate mechanism 40 and the drive shaft 60 via the drive lug 202 and is movable radially with respect to the lug 202 and the wobble plate mechanism in response to axial movement of the sleeve 180. It will thus be appreciated that as the angle of the wobble plate mechanism 40 is varied with respect to the drive shaft axis, between its solid and dashed line positiones, it is possible to infinitely vary the stroke lengths of the pistons 166 and thus the output of the compressor.

The hydraulic control circuit for the compressor 10 is indicated in part by short arrows 58 in FIG. 1. Thus, oil is drawn-up from the compressor sump area 71 through the pickup tube 74 through the aperture 76 in the suction inlet reed disc 77 and thence into the passage means in the form of a generally vertical slot or groove 78 formed in the inner face of the valve plate 80. The gear pump assembly 72 pressurizes the oil as the pump is rotated on the rearward end of the compressor shaft 60.

Figure 2:
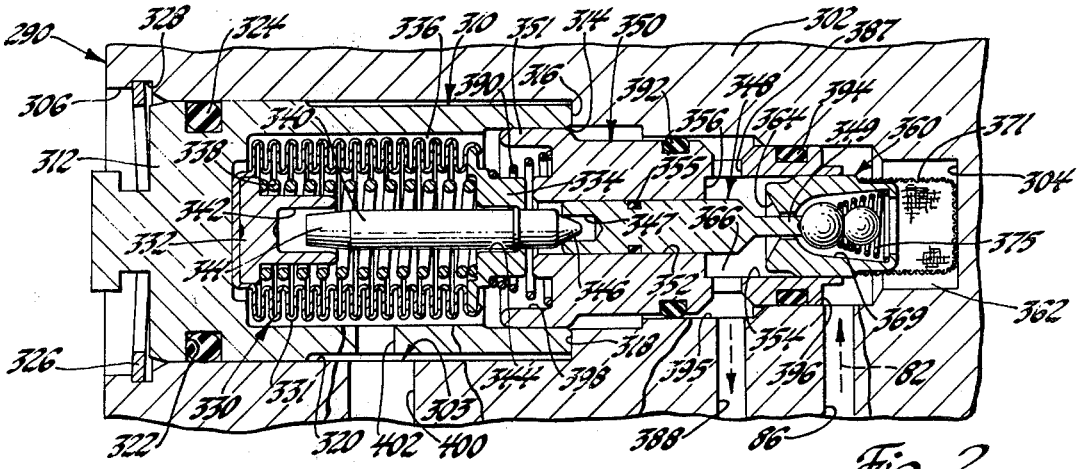
FIG. 2 is an enlarged fragmentary sectional view of the control valve taken substantially on the line 2—2 of FIG. 1.

The modulation oil flow path, indicated in part by dashed arrows 82 shown in FIGS. 1 and 2, involves flow from the outlet of the pump 72 into the upper oil outlet groove 84 for flow rearwardly through hole 79 in the valve plate 80 and thence via rear head and valve housing bore 86 for entrance into the blind end region or inlet cavity 362 of a hydraulic control valve, generally indicated at 290 in FIG. 1. The control valve 290, which is the subject of the present invention, functions to control the travel or stroke of the compressor pistons 166.

Turning now to a detailed description of the control valve, it will be seen in FIG. 2 that the hydraulic pressure operated control valve assembly 290 includes a housing 302 which in the preferred form is formed integrally in the rear head assembly 140, as seen in FIG. 1, defining a stepped blind bore 303, a closed end 304 and an open end 306. A valve bellows cover, generally indicated at 310, in the form of a tubular member having a closed outer end 312 and an open inner end 314 disposed inwardly, is telescopically inserted into the housing open end 306. The bellows cover 310 is inserted sealingly into a fixed position in one open end 306 of the housing stepped bore 303 with the cover free edge 316 engaged by shoulder 318 formed by outermost counterbore 320 of the stepped bore. In the preferred form the cover 312 has an annular groove 322 receiving an O-ring 324 which is in sealing contact with counterbore 320. Retaining means, such as C-ring 326, is snapped into interior groove 328 to hold the cover 310 in place. Thus, the bellows over 310 has its closed end 312 positioned adjacent the open end 306 of the housing 302 and its open end 314 facing inwardly toward the closed end 304 of the housing stepped bore 303.

A sealed flexible bellows member 330 is concentrically located within the bellows cover 310 so as to be seated against its closed end 312. The bellows member 330 is a tubular cuplike thin-walled metal casing 331 with corrugations formed in its side surface having an outer end member 332 at its closed end and an inner end guide member 334 at its open end operative to seal the bellows interior. The inner end member 334 projects toward the open end 314 of the bellows cover while the opposite end member is seated on the closed end of the bellows cover. The interior of the bellows casing is evacuated so as to expand and contract in response to pressure changes within bellows cover pressure control cell 336 preset to a predetermined size. A compression coil spring 338, located interiorly of the bellows member 330, extends between the end members 332 and 334. The captured spring 338 is spaced and centered from a rod 340 such that the spring 338 normally maintains the bellows member 330 in an extended position. The bellows rod 340 is tapered at 341 and guided into axial recess 342 in the fixed end member 332 for over-travel movement of the rod inwardly of the bellows member 330. The rod 340 extends on the axis of the housing cover blind bore 303 through aligned guide bore 344 of the end member 334. The rod 340 has a pointed inner end 346 which seats into a coupling axial recess 347 of a valve pin member 348. The pin member 348 terminates at its inner end in a reduced valve needle or stem portion 349.

A cylindrical valve body, indicated generally at 350, is formed with an enlarged head portion 351 which is telescopically received in a press fit calibration manner within the open end 314 of the bellows cover 310. The valve body extends sufficiently within the open end 314 of the cover 310 to provide an axially adjustable sealed juncture operable during an assembly and setting procedure to be described. It will be noted that when the valve body head 351 is press fitted within the bellows cover the rod pointed inner end automatically aligns and couples with the valve pin recess 347 whereby the bellows rod 340 and valve pin 348 move axially in unison.

A stepped axial bore extends through the valve body 350 defining first 352 and second 354 bores wherein the second bore 354 has a diameter of the order of twice the first bore 252 to define an internal shoulder 356. The first diameter bore 352 has its upper end located adjacent the bellows free end member 334 while the second diameter bore 354 is located adjacent the closed end 304 of the housing bore 303. The actuating pin member 348 is reciprocatingly sealed in the valve body first bore 352 by O-ring seal 355.

A valve sleeve member 360 is telescopically received in a press fit within the valve body second bore 354 to define with the closed end 304 of the housing an inlet cavity 362. The valve sleeve member 360 has an outwardly diverging or truncated cone-shaped portion 364 partially defining with the valve body shoulder 356 a fluid outlet cavity 366.

Figure 3:
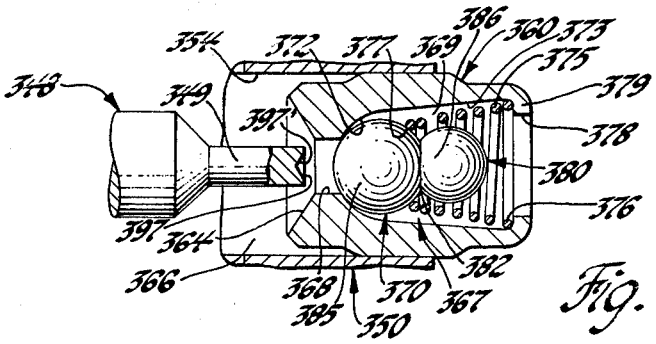
FIG. 3 is an enlarged fragmentary vertical sectional view of the ball and seat portion of the control valve.

As best seen in FIG. 3, the valve sleeve member 360 is formed with an axial throat passage or outlet end 368 interconnecting a valve chamber 369 with outlet cavity 366. The valve chamber 369 has valve and guide means, generally indicated at 367, positioned therein for reciprocal movement. The valve and guide means comprises first 370 and second 380 ball segments and a conical coil compression spring 375 of helically wound wire. In the disclosed embodiment the valve chamber 369 has a bell-shaped configuration including a portion 373 converging from the chamber inlet end 378 in a manner to form a dome-shaped valve seat portion 372 of a predetermined radius at the chamber outlet end 368. The first valve ball segment 370 is movable in the dome-shaped valve seat portion 372 between valve open (FIG. 2) and valve closed (FIG. 3) positions. The ball segment 370 is of a predetermined configuration and size to mate in sealing relation with the valve seat portion 372 when in the valve closed position. The conical coil compression spring 375, defining second resilient means for the control valve assembly, has large 376 and small 377 diameter ends. The valve and guide means 367 is axially positioned in the valve chamber 369 with its spring 375 having its large diameter end 376 suitably retained in the chamber.

In the preferred form the valve and guide means 367 is retained by employing a suitable fixture which compresses the spring 375 allowing a forming tool to "spin" the edge of the sleeve member 360 to form an inwardly directed peripheral retaining lip or flange 379. The flange 379 thus defines the large entrance opening or inlet end 378 while retaining the guide means 367 in the chamber by virtue of the spring large end 376 being in abutting engagement with flange 379.

The small ball segment 380 of the valve and guide means 367 is of a predetermined configuration and size less than the large ball segment 370, located adjacent the chamber inlet end 378. The ball segments 370 and 380 have their respective large and small substantially spherical surfaces secured together, as by welding, so as to be in abutting relation along a common plane, indicated at 382, to form a unitary piece having large 385 and small 386 ball portions, the unitary piece being defined by the first 370 and second 380 ball segments. The large ball portion 385 consists of the semi-spherical area of ball segment 370 opposite the plane 382, forms a valve for the dome-shaped valve seat portion 372. The small ball portion 386 comprises the truncated spherical portion 386 of ball segment 380 adjacent the plane 382, coacts with the spring 375 to form a guide for the unitary piece. In this manner the spring 375 is carried in the valve chamber 369 and converges with the portion 373 so as to be concentrically aligned at the principal axis of the valve chamber.

It will be noted in FIG. 3 that the conical spring smaller end 377 has a slightly smaller internal diameter than the diameter of the second ball segment 380 allowing the spring end 377 to be snap-fastened over the small ball portion 386 for capture between the large 370 and small 380 ball segments substantially at the common plane 382. Applicant's arrangement facilitates the universal movement of the unitary piece with respect to the spring so that the large ball portion 385 will mate with the valve seat portion 372 sufficiently to assure their sealing relation when the valve and guide means 367 is in the valve closed position. Thus, the large ball segment 370 is guidingly retained for movement in the valve chamber 369 between the valve open and closed positions by the coaction of the small ball portion 386 with the spring 375 so as to be biased by the spring 375 toward the valve closed position against the valve seat portion 372. Upon the needle 349 engaging the large ball portion 385 through the outlet end 368 the needle 349 moves the valve and guide means 367 toward its valve open position against the bias of the spring 375. The outlet end 368 has a configuration sufficiently large simultaneously to receive the needle 349 and supply the hydraulic fluid in regulating the flow thereof to cavity 366 when the valve and guide means 367 is away from the valve seat portion 372 and between the valve open and valve closed positions.

As best seen in FIG. 3, the valve needle 349 has an outer diameter less than the inner diameter of valve throat outlet end 368 by a predetermined amount so as to simultaneously receive the needle 349 and supply the hydraulic fluid in regulating the outlet flow thereof when the valve and guide means 367 is away from the valve seat portion 372 and between the valve open and closed positions. Upon the unsealing of the valve ball segment 370 high pressure liquid is free to flow from inlet cavity 362 and ball chamber 369 through the valve chamber outlet end 368 into the outlet cavity 366 for exit via a pair of outlet ports 387 into passage means 388. It will be noted that valve body 350 has a pair of O-ring seals 392 and 394 positioned in sealing engagement with housing counterbore portions 395 and 396 respectively, on either side of the outlet cavity ports 387 to seal the outlet cavity and its outlet passage 388 from the inlet cavity 362 and the bellows cell 336. A valve screen, shown at 371, is provided in the inlet cavity 362 to filter out particles from fluid entering the ball chamber 369.

It will be appreciated that applicant's improved spring loaded ball and seat valve allows for ready snap-fit attachment of the spring 375 over the small ball portion 386 providing ease of handling during assembly. The guide means 367, composed of the spring 375 and the joined ball segments 370 and 380, is readily inserted as a subassembly in the chamber 396 and retained during the formation of the lip 379. Thus, applicant's valve design achieves an inexpensive hydraulic valve combining the quick response opening and closing characteristics of a ball valve together with the self-aligning universal movement attained by the two-ball unitary piece to assure proper mating of the ball seat area or large ball portion 38 with the valve seat 372. In the form shown the large ball segment 370 has a diam. of about 4.00 mm while the small ball segment 380 has a diam. of about 3.20 mm. The outlet passage 36 has a diam. of about 2.41 mm for reception of the needle 349 which has a diam. of about 1.60 mm. The valve seat portion 372 has a spherical radius of about 2.40 mm to join with the chamber portion 373 which converges at a $2\frac{1}{2}°$ taper. The spring 375 wire size is about 0.41 mm with its two closed small end coils having inside diams. of about 3.00 mm and its large end 376 outer diam. is about 5.54 mm.

Upon axial inward movement of the needle 349, caused by the extension of the bellows member 330 against spring 390, the needle free end 397 contacts ball portion 385 to move and unseat same compressing spring 375 substantially along the principal axis of the valve chamber. It will be noted that the needle free end 397 has a conical recess 397' which stabilizes the ball segments relative to the needle to minimize vibration therebetween.

First resilient means, in the form of the conical compression spring 390, is concentrically positioned or centered intermediate the bellows end member 334 and the ring-shaped depression 398 of valve housing 350. The coil spring 390 urges the bellows 330 into engagement with the closed end 312 of the cover 310 and thus away from the valve pin member 348. The second resilient means, in the form of the conical ball spring 375, acts to bias the valve ball segment 370 in a direction toward the left (FIG. 2) to seat the ball segment 370 and close communication between the inlet cavity 362 and the outlet cavity 366. It will be noted that the compression spring 338, which is encapsulated in the evacuated bellows member 330 provides, in combination with the bellows casing, a pressure dependent displacement. In the disclosed form the pressure inside the bellows member 330 may be either absolute zero or gas-charged to a reference pressure, referenced to zero.

The procedure for assembling and setting the control valve 290 is as follows. The control valve body 350 is inserted into a suitable holding fixture. Next, the bellows cover 310 is installed over the bellows-spring assembly allowing the valve body 350 to be press fitted into the bellows cover 310 a predetermined axial distance which in the disclosed embodiment is about 4 mm. This assembled portion of the valve is then normalized or stress relieved by suitable means such as being placed into a pressure tank at a pressure of $195 \pm 5$ psig and at a temperature of 150°–180° F.

After the normalizing procedure the first step in presetting the control valve involves assembling the valve seat 360, the valve body 350 and the pin 348 by inserting the pin member 348 and O-ring 355 into the valve body first bore 352. The valve sleeve assembly 360 is then inserted into a suitable holding fixture and the bellows is fully extended to move the pin 348 and needle 349 to the right into the chamber 369 to its full length. Next, the sleeve assembly 360 is press fitted into the valve body larger bore 354 while 90 psig air pressure is applied to the valve chamber 369 which together with the ball spring 375 acts to seat the ball portion 385. As soon as the ball portion 385 touches or contacts the needle free end 397 the ball portion 385 is unseated to provide an opening between the portion 385 and the valve seat allowing the pressurized air in the valve seat chamber 369 to exit through the valve seat throat 368. This axial "break open" location of the valve ball 370 is suitably noted and the valve sleeve assembly 360 is moved from said location an additional predetermined distance which in the disclosed form is a distance of 0.8 millimeters into the valve body second bore 354. It will be appreciated that the above location or setting of the valve seat assembly 360 establishes the maximum travel of the valve pin member 348 together with its needle or stem 349 because the bellows member 330 and rod 344 are extended to their maximum axial position.

The next step in setting the control valve requires locating the valve body 350 relative to the bellows cover 310. This involves inserting the assembled valve body 350 and sleeve 360 into a suitable fixture and press fitting the bellows cover open end 314 in the valve body head 351. Suitable test stand apparatus is provided for applying 90 pounds air pressure to the ball cavity 369. At the same time the calibrating or valve setting apparatus applies about 44.2 pounds per square inch absolute (psia) air pressure, i.e. about 30 pounds gauge pressure, into the bellows pressure control cell 336 via aligned housing and cover bores 400 and 402. The result is a retraction of the bellows member 330 to a given or predetermined length wherein the valve ball portion 385 seats to close throat 368. Next, an axial force is applied to the valve assembly so as to telescope the valve cover 310 and valve body 350 together at their press fit juncture until needle free end 397 "picks-up" or contacts the ball portion 385 and compresses spring 375 to again unseat and open the ball portion 385 allowing calibrating pressurized air supplied to chamber 369 to flow into exit cavity 366 via throat 368 and housing passageway 388. The bellows cover 310 and valve body 350 remain under axial pressure causing them to be telescoped together at their press fit juncture to establish a flow into an outlet calibrating circuit having an outlet passage of 0.8 mm diameter and a length of 2.2 mm sufficient to create a pressure setting of about 45 psig. within the calibrating outlet circuit.

Upon completion of the above-described setting procedure on the "air-board" calibration or setting apparatus the preset control valve is inserted into the compressor housing bore 303 in a sealed manner as shown in FIG. 2. In operation, rotation of the drive shaft 60 will develop a pressure of about 90 psig at the compressor pump 72 outlet and cause the hydraulic fluid or oil to flow through passage 86 into the valve inlet cavity 362. It will be noted that the bellows pressure control cell 336 is in continuous communication with the system control pressure area, which could be the compressor suction inlet chamber 143, the system evaporator (not shown), etc. by suitable passage means.

As seen in FIGS. 1 and 2 of the preferred embodiment the control point for the hydraulic valve is sensed from the compressor suction cavity 143 by means of aperture or passage 400 extending through the rear head 140 valve housing 302 aligned with bellows cover aperture 402. Thus, applicant's arrangement provides direct pressure sensing between the bellows control cell 336 and the suction cavity 143 thereby eliminating the need for an external pressure transmitting tube and end connections required if the control valve is sensed from the system evaporator. The suction cavity inlet (not shown) is connected to the outlet of the system evaporator through suitable tubular means including an accumulator/dehydrator (not shown) as disclosed, for example, in U.S. patent application Ser. No. 785,333 to J. D. Livesay.

It will be appreciated that if the compressor 10 is operating at or near maximum capacity and little or no refrigeration is required the high side pressure will build up and the low side or suction pressure in cavity 143 will drop, for example, to a value approaching a pressure of about 30 psig. Dropping the low side or suction pressure lowers the cooling coil or evaporator temperature. If the pressure transmitted from the cavity 143 is reduced to the cell control setting pressure, i.e. about 30 psig., the bellows 331 expands and extends the valve pin needle 349 unseating the ball portion 385. The result is that oil is allowed to exit the housing outlet passageway 388 at a pressure of about 45 psig. for flow into the compressor modulation chamber 206 to expand same and, via the wobble plate 152 being pivoted to its dashed-line position, start reducing the compressor pistons 166 stroke or travel, i.e. start "destroking" the compressor.

Upon pressure from the system control pressure area (suction cavity 143) again reaching or exceeding the pressure cell 336 setting pressure the bellows will retract, assisted by the first resilient means (spring 390) a sufficient distance to allow the second resilient means, (spring 375) together with the high oil pressure acting against the ball segments 370 and 380 to close or seat the ball portion 385 on the valve seat portion 372 totally restricting oil flow to the valve outlet cavity 366. The result is that the expansible chamber 206 is bled of oil through oil bleed hole or passage 207 by the swash plate mechanism's tendency to return to its full stroke position thus moving the modulation cylinder piston 194 toward its full line position shown in FIG. 1. It will be noted that the bleed passage 207 in cylinder base 122 is formed of a predetermined size (diameter of 0.8 mm and a length of 2.2 mm) or the same as the outlet opening of the mentioned calibrating circuit. Thus, applicant's valve is designed whereby the hydraulic system pressure developed by the pump 72 will produce the required pressure (45 psig.) in the chamber 206 while oil is being bled from passage 207.

While the embodiment of the present invention as herein disclosed constitutes a preferred form, it is to be understood that other forms might be adopted.

The embodiments of the invention in which an exclusive property or privilege is claimed are defined as follows:

1. A pressure operated hydraulic control valve assembly for controlling a compressor of an automative air conditioning system, the compressor having an hydraulically operated modulating means for varying the output thereof, and pump means for supplying hydraulic control fluid to said modulating means, said valve assembly comprising a housing, a tubular bellows cover and a cylindrical valve body, said bellows cover and said housing each having a closed end and an open end, the closed end of said bellows cover insertable sealingly into a fixed position in one end of said housing with its open end disposed inwardly, a sealed bellows seated in the closed end of said bellows cover and including a free end projecting toward the open end of said cover, said bellows having a predetermined cell control pressure, said valve body sealingly insertable in said housing with an end head portion telescopically received in a press-fit sufficiently within the open end of said cover to define a pressure control cell of predetermined size enclosing said bellows, a stepped axial bore through said valve body defining first and second diameter bores, said first diameter bore being adjacent the free end of said bellows and said second bore adjacent the closed end of said housing, a valve sleeve received in a press fit within said second bore sufficiently with respect to said valve body and the closed end of said housing to define an outlet cavity and an inlet cavity, respectively; said valve sleeve formed with an axial bore therethrough forming a valve seat between said inlet and outlet cavities, an actuating pin member reciprocatingly, sealingly received in the first diameter bore of said valve body, said actuating pin member having a stem portion passing through the axial bore of said valve sleeve in non-fluid blocking relation therewith, ball valve means positioned in said inlet cavity adjacent said valve seat, said actuating pin member extending through said first and second diameter bores into engagement with the free end of said bellows at one end thereof and said ball valve means at the other end thereof, said ball valve means operative to open and close communication between the inlet and outlet cavities in response to reciprocating movement of said pin member, aperture means in said housing and said bellows cover adapted to communicate a suction control pressure from said compressor to said bellows pressure control cell, first resilient means urging said bellows into engagement with the closed end of said cover and away from said pin member, second resilient means biasing said ball valve means in a direction to close communication between said inlet and outlet cavities, inlet port means in said housing adapted to place said inlet cavity in communication with said pump means, outlet port means in said housing adapted to place said outlet cavity in communication with said modulating means, whereby to vary the supply of control fluid from said inlet cavity to said outlet cavity during control of said compressor, said first resilient means acting to collapse said bellows and release said pin member so that said second resilient means may urge said ball valve means to adjustably close communication between said inlet and outlet cavities to control said compressor in one manner when the suction control pressure from the compressor exceeds the predetermined cell control pressure, and said bellows expanding to act against said first and second resilient means to force said ball valve means away from said valve seat to adjustably open communication between said inlet and outlet cavities to control said compressor in another manner when the suction control pressure from said compressor is less than said predetermined cell control pressure.

2. In a variable output automotive air conditioning compressor, casing means including a front end cover and a rear head enclosing a cylinder block, hydraulically operated modulating means for varying the output of said compressor, pump means for supplying hydraulic fluid to said modulating means, said rear head inner face formed with suction and discharge cavities on its inner face, a closed end valve housing integrally formed on said head, said valve housing forming a part of a control valve assembly further including a tubular bellows cover and a cylindrical valve body, said bellows cover having a closed end and an open end, the closed end of said bellows cover insertable sealingly into a fixed position in one end of said housing with its open end disposed inwardly, a sealed bellows seated in the closed end of said bellows cover and including a free end projecting toward the open end of said cover, said bellows having a predetermined cell control pressure, said valve body sealingly insertable in said housing with an end head portion telescopically received in a press-fit sufficiently within the open end of said cover to define a suction pressure control cell of predetermined size enclosing said bellows, a stepped axial bore through said valve body defining first and second diameter bores, said first diameter bore being adjacent the free end of said bellows and said second bore adjacent the closed end of said housing, a valve sleeve received in a press fit within said second bore sufficiently with respect to said valve body and the closed end of said housing to define an outlet cavity and an inlet cavity, respectively; said valve sleeve formed with an axial bore therethrough forming a valve seat between said inlet and outlet cavities, an actuating pin member reciprocatingly, sealingly received in the first diameter bore of said valve body, said actuating pin member having a stem portion passing through the axial bore of said valve sleeve in non-fluid block relation therewith, ball valve means positioned in said inlet cavity adjacent said valve seat, said actuating pin member extending through said first and second diameter bores into engagement with the free end of said bellows at one end thereof and said ball valve means at the other end thereof, said ball valve means operative to open and close communication between the inlet and outlet cavities in response to reciprocating movement of said pin member, aperture means in said rear head valve housing in communication with aperture means in said bellows cover adapted to communicate a suction control pressure from said compressor rear head suction cavity to said bellows pressure control cell, first resilient means urging said bellows into engagement with the closed end of said cover and away from said pin member, second resilient means biasing said ball valve means in a direction to close communication between said inlet and outlet cavities, inlet port means in said housing adapted to place said inlet cavity in communication with said pump means, outlet port means in said housing adapted to place said outlet cavity in communication with said modulating means, whereby to vary the supply of control fluid from said inlet cavity to said outlet cavity during control of said compressor, said first resilient means acting to collapse said bellows and release said pin member so that said second resilient means may urge said ball valve means to adjustably close communication between said inlet and outlet cavities to control said compressor in one manner when the suction control pressure from the compressor exceeds the predetermined cell control pressure, and said bellows expanding to act against said first and second resilient means to force said ball valve means away from said valve seat to adjustably open communication between said inlet and outlet cavities to control said compressor in another manner when the suction control pressure from said compressor is less than said predetermined cell control pressure.

3. A spring loaded ball and seat valve for use in regulating the flow of high pressure hydraulic fluid, said valve comprising means defining a substantially cylindrical open ended sleeve having an inlet end adapted to receive said hydraulic fluid and an outlet end adapted to supply said hydraulic fluid, the inside of said sleeve formed as a valve chamber with a portion converging from the inlet end toward the outlet end in a manner to form a dome-shaped valve seat portion adjacent the outlet end, valve and guide means positioned for reciprocal movement in said valve chamber, said valve and guide means comprising first and second ball segments and a helical compression spring, said first ball segment movable in said dome-shaped portion between valve open and valve closed positions and of predetermined configuration and size to mate in sealing relation with said valve seat portion when said valve and guide means is in said valve closed position, said second ball segment movable in said converging portion and of predetermined configuration and size less than said first ball segment and located adjacent said inlet end, said ball segments having their respective configurations secured together in abutting relation along a common plane of said ball segments to form a unitary piece having large and small ball portions defined by said first and second ball segments, said large ball portion forming a valve for said valve seat portion and said small ball portion coacting with said spring to form a guide for said unitary piece, said spring carried in said valve chamber and converging therewith, said spring substantially concentrically aligned on the principal axis of said valve chamber with its larger diameter end entrapped in said chamber by the inside of said inlet end and its smaller diameter end snap-fastened over said small ball portion for capture between said first and second ball segments substantially at said common plane in a manner to facilitate the universal movement of said unitary piece with respect to said spring so that said large ball portion will mate with said valve seat portion sufficiently to assure said sealing relation when said valve and guide means is in said valve closed position, said large ball portion being guidingly retained for movement in said valve chamber between said valve open and valve closed positions of said valve and guide means by the said coaction of said small ball portion with said spring and being biased by said spring toward said valve seat portion, and needle means engageable with said large ball portion through said outlet end for moving said valve and guide means toward its valve open position against the bias of said spring, said outlet end having a configuration sufficiently large simultaneously to receive said needle means and supply said hydraulic fluid in regulating the flow thereof when said valve and guide means is away from said valve seat portion and between said valve open and valve closed positions.

4. A pressure operated control valve assembly for controlling the supply of control fluid to the modulating means of a variable capacity compressor for controlling the output of said compressor, said valve assembly comprising a housing, a tubular bellows cover and valve body, said bellows cover and said housing each having a closed end and an open end, the closed end of said bellows cover insertable sealingly into a fixed position in one end of said housing with its open end disposed inwardly, a sealed bellows seated in the closed end of said bellows cover and including a free end projecting toward the open end of said cover, said bellows having a predetermined cell control pressure, said valve body sealingly insertable in said housing with an end head portion telescopically received sufficiently within the open end of said cover to define a pressure control cell of predetermined size enclosing said bellows, an axial bore through said valve body defining first and second bore portions, said first bore portion being adjacent the free end of said bellows and said second bore portion adjacent the closed end of said housing, a valve sleeve received within said second bore sufficiently with respect to said valve body and the closed end of said housing to define an outlet cavity and an inlet cavity, respectively; said valve sleeve formed with an axial bore therethrough forming a valve seat between said inlet and outlet cavities, an actuating pin member reciprocatingly, sealingly received in the first bore portion of said valve body, said actuating pin member having a stem portion passing through the axial bore of said valve sleeve in non-fluid blocking relation therewith, ball valve means positioned in said inlet cavity adjacent said valve seat, said actuating pin member extending through said first and second bore portions into engagement with the free end of said bellows at one end thereof and said ball valve means at the other end thereof, said ball valve means operative to open and close communication between the inlet and outlet cavities in response to reciprocating movement of said pin member, aperture means in said housing and said bellows cover adapted to communicate a compressor control pressure to said bellows pressure control cell, first resilient means urging said bellows away from said pin member, second resilient means biasing said ball valve means in a direction to close communication between said inlet and outlet cavities, inlet port means in said housing adapted to place said inlet cavity in communication with the supply of control fluid, outlet port means in said housing adapted to place said outlet cavity in communication with said modulating means, whereby to vary the supply of control fluid from said inlet cavity to said outlet cavity during control of said compressor, said first resilient means acting to collapse said bellows and release said pin member so that said second resilient means may urge said ball valve means to adjustably close communication between said inlet and outlet cavities to control said compressor in one manner when the compressor control pressure exceeds the predetermined cell control pressure, and said bellows expanding to act against said first and second resilient means to force said ball valve means away from said valve seat to adjustably open communication between said inlet and outlet cavities to control said compressor in another manner when the compressor control pressure is less than said predetermined cell control pressure.

5. A spring loaded ball and seat valve for use in regulating the flow of hydraulic fluid, said valve comprising means defining a substantially cylindrical open ended sleeve having an inlet end adapted to receive said hydraulic fluid and an outlet end adapted to supply said hydraulic fluid, the inside of said sleeve formed as a valve chamber with a portion converging from the inlet end toward the outlet end in a manner to form a dome-shaped valve seat portion adjacent the outlet end, and valve and guide means positioned for reciprocal movement in said valve chamber, said valve and guide means comprising first and second ball segments and a helical compression spring, said first ball segment movable in said dome-shaped portion between valve open and valve closed positions and of predetermined configuration and size to mate in sealing relation with said valve seat portion when said valve and guide means is in said valve closed position, said second ball segment movable in said converging portion and of predetermined configuration and size less than said first ball segment and located adjacent said inlet end, said ball segments having their respective configurations secured together in abutting relation along a common plane of said ball segments to form a unitary piece having large and small ball portions defined by said first and second ball segments, said large ball portion forming a valve for said valve seat portion and said small ball portion coacting with said spring to form a guide for said unitary piece, said spring carried in said valve chamber and converging therewith, said spring substantially concentrically aligned on the principal axis of said valve chamber with its larger diameter end entrapped in said chamber by the inside of said inlet end and its smaller diameter end snap-fastened over said small ball portion for capture between said first and second ball segments substantially at said common plane in a manner to facilitate the universal movement of said unitary piece with respect to said spring so that said large ball portion will mate with said valve seat portion sufficiently to assure said sealing relation when said valve and guide means is in said valve closed position, said large ball portion being guidingly retained for movement in said valve chamber between said valve open and valve closed positions of said valve and guide means by the said coaction of said small ball portion with said spring and being biased by said spring toward said valve seat portion.

6. In a variable output refrigerant compressor having a housing containing a hydraulic fluid, a cylinder block disposed in said housing and having a plurality of cylinder bores, a drive shaft rotatable with respect to said cylinder block, pistons arranged to reciprocate in said cylinder bores and adapted by the stroke thereof to pump refrigerant to and from the condenser and evaporator of an automobile air conditioning system and to provide thereby a signal of the operating condition of said system, a wobble plate mechanism pivotally connected at said drive shaft, compressor output modulation means actuatable for increasing the angle of said wobble plate relative to the axis of said drive shaft and thus reducing the stroke of said compressor pistons in said bores to reduce the amount of refrigerant pumped, said wobble plate mechanism being drivingly connected to said compressor pistons in a manner tending to return said pistons toward full stroke position when refrigerant is being pumped for decreasing the angle of said wobble plate relative to the axis of said drive shaft and thus increasing the stroke of said pistons in said bores to increase the amount of refrigerant being pumped, and an expansible chamber type actuator including a modulation member movable in one direction in response to a controlled pressure in the chamber of said actuator for actuating said output modulation means and movable in another direction in response to the wobble plate mechanism's tendency to return said pistons toward full stroke position, the combination including control means for said compressor including pump means and a control valve assembly for receiving said signal and said hydraulic fluid to be pumped to said chamber in a controlled amount to provide the controlled pressure for moving said modulation member in said one direction for actuating said output modulation means, said control valve assembly controlling the amount of hydraulic fluid pumped to the expansible chamber for varying the output of said compressor, said control valve assembly including an inlet passage in communication with said housing for receiving the pumped hydraulic fluid therefrom, an outlet passage in communication with said chamber and a valve for opening and closing communication between said passages, said valve opening in response to a signal received from said air conditioning system to reduce the amount of refrigerant being pumped and closing in response to a signal received from said air conditioning system to increase the amount of refrigerant being pumped, and means for bleeding said hydraulic fluid from said chamber as said modulation member moves in the other direction in response to the tendency of said wobble plate mechanism to return said pistons toward full stroke so that the angle of said wobble plate relative to the axis of said drive shaft may be decreased thereby to increase the amount of refrigerant being pumped.

7. In a variable output refrigerant compressor having a housing containing a hydraulic fluid, a cylinder block disposed in said housing and having a plurality of cylinder bores, a drive shaft rotatable with respect to said cylinder block, pistons arranged to reciprocate in said cylinder bores and adapted by the stroke thereof to pump refrigerant to and from the condenser and evaporator of an automobile air conditioning system and to provide thereby a signal of the operating condition of said system, a wobble plate mechanism pivotally connected at said drive shaft, compressor output modulation means actuatable for increasing the angle of said wobble plate relative to the axis of said drive shaft and thus reducing the stroke of said compressor pistons in said bores to reduce the amount of refrigerant pumped, said wobble plate mechanism being drivingly connected to said compressor pistons in a manner tending to return said pistons toward full stroke position when refrigerant is being pumped for decreasing the angle of said wobble plate relative to the axis of said drive shaft and thus increasing the stroke of said pistons in said bores to increase the amount of refrigerant being pumped, and an expansible chamber type actuator including a modulation member movable in one direction in response to a controlled pressure in the chamber of said actuator for actuating said output modulation means and movable in another direction in response to the wobble plate mechanism's tendency to return said pistons toward full stroke position, the combination including control means for said compressor including pump means and a control valve assembly in communication with said housing for receiving said signal and said hydraulic fluid to be pumped to said chamber in a controlled amount to provide the controlled pressure for moving said modulation member in said one direction for actuating said output modulation means, said control valve assembly controlling the amount of hydraulic fluid pumped to the expansible chamber for varying the output of said compressor, said control valve assembly including an inlet passage in communication with said housing for receiving the pumped hydraulic fluid therefrom, an outlet passage in communication with said chamber and a valve for opening and closing communication between said passages, said valve opening in response to a signal received from said air conditioning system to reduce the amount of refrigerant being pumped and closing in response to a signal received from said air conditioning system to increase the amount of refrigerant being pumped, and means for bleeding said hydraulic fluid from said chamber as said modulation member moves in the other direction in response to the tendency of said wobble plate mechanism to return said pistons toward full stroke so that the angle of said wobble plate relative to the axis of said drive shaft may be decreased thereby to increase the amount of refrigerant being pumped, said bleeding means operable for bleeding hydraulic fluid from said chamber when said modulation member is moving in either direction, the amount of hydraulic fluid bleeding from said chamber when said modulation member is moving in said one direction being sufficient to maintain said controlled pressure in said chamber.

* * * * *

UNITED STATES PATENT AND TRADEMARK OFFICE

CERTIFICATE OF CORRECTION

PATENT NO. : 4,236,875

DATED : December 2, 1980

INVENTOR(S) : Richard E. Widdowson

It is certified that error appears in the above-identified patent and that said Letters Patent are hereby corrected as shown below:

Column 3, line 7, "enbodiment" should read -- embodiment --.

Column 3, line 51, "is" should read -- in --.

Column 5, line 27, "rotation" should read -- relation --.

Column 6, line 38, "this" should read -- the --.

Column 7, line 20, "over" should read -- cover --.

Column 12, line 38, "automative" should read -- automotive --.

Signed and Sealed this

*Ninth* Day of *June 1981*

[SEAL]

*Attest:*

RENE D. TEGTMEYER

*Attesting Officer* *Acting Commissioner of Patents and Trademarks*